United States Patent [19]

Roguebrune

[11] Patent Number: 5,056,169

[45] Date of Patent: Oct. 15, 1991

[54] BATHING APPARATUS FOR HANDICAPPED PEOPLE AND THE LIKE

[76] Inventor: Joseph P. A. Roguebrune, 6415 East Broadway, Burnaby, B.C., Canada, V5B 2Y4

[21] Appl. No.: 543,282

[22] Filed: Jun. 25, 1990

Related U.S. Application Data

[63] Continuation-in-part of Ser. No. 388,795, Aug. 2, 1989, Pat. No. 4,993,087.

[51] Int. Cl.[5] ..... A47K 3/02

[52] U.S. Cl. ..... 4/556; 4/584

[58] Field of Search ..... 4/555, 556, 559, 584, 4/604, 605, 613, 614, 615; 128/365, 369

[56] References Cited

U.S. PATENT DOCUMENTS

| | | | |
|---|---|---|---|
| 3,371,354 | 3/1968 | Hayslett | 4/556 |
| 3,380,078 | 4/1968 | Hanson | 4/555 |
| 3,416,166 | 12/1968 | Hanson | 4/555 |
| 4,112,524 | 9/1978 | Johansson | 4/560 X |
| 4,365,367 | 12/1982 | Houle et al. | 4/555 |
| 4,542,545 | 9/1985 | Johnson et al. | 4/555 |
| 4,546,506 | 10/1985 | Houle et al. | 4/555 |
| 4,583,251 | 4/1986 | Fürst et al. | 4/555 |
| 4,742,456 | 5/1988 | Kamena | 4/542 X |
| 4,757,561 | 7/1988 | Crump | 4/604 |
| 4,796,312 | 1/1989 | Corlew | 4/555 |

FOREIGN PATENT DOCUMENTS

| | | | |
|---|---|---|---|
| 109960 | 5/1984 | European Pat. Off. | 4/555 |
| 1478999 | 3/1967 | France | 4/555 |
| 1213358 | 11/1970 | United Kingdom | 4/555 |
| 1226206 | 3/1971 | United Kingdom | 4/555 |
| 1582900 | 1/1981 | United Kingdom | 4/555 |

*Primary Examiner*—Henry J. Recla
*Assistant Examiner*—Robert M. Fetsuga
*Attorney, Agent, or Firm*—Townsend and Townsend

[57] ABSTRACT

A bathtub having one panel which slides down, allows entrance for a handicapped person in a wheelchair or on a trolley without having to climb over the side. The bathtub permits a handicapped person to be independent and not rely on others. One fixed vertical side is joined to two end walls extending up from a bottom surface to form a bathtub, a sliding panel, representing at least a portion of the other vertical side of the bathtub, is mounted in tracks in the two end walls. The tracks extend down and curve under the bathtub allowing the sliding panel to be lowered to a lowered position to permit entry and exit. The sliding panel can be raised and lowered between the lowered and raised positions, and a seal is provided to seal the panel in the raised position.

10 Claims, 3 Drawing Sheets

Fig. 4.
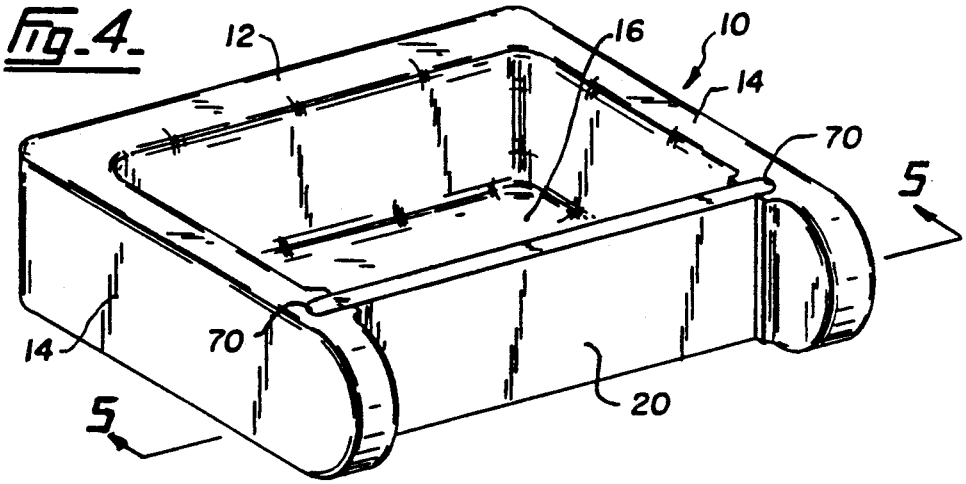
Fig. 5.
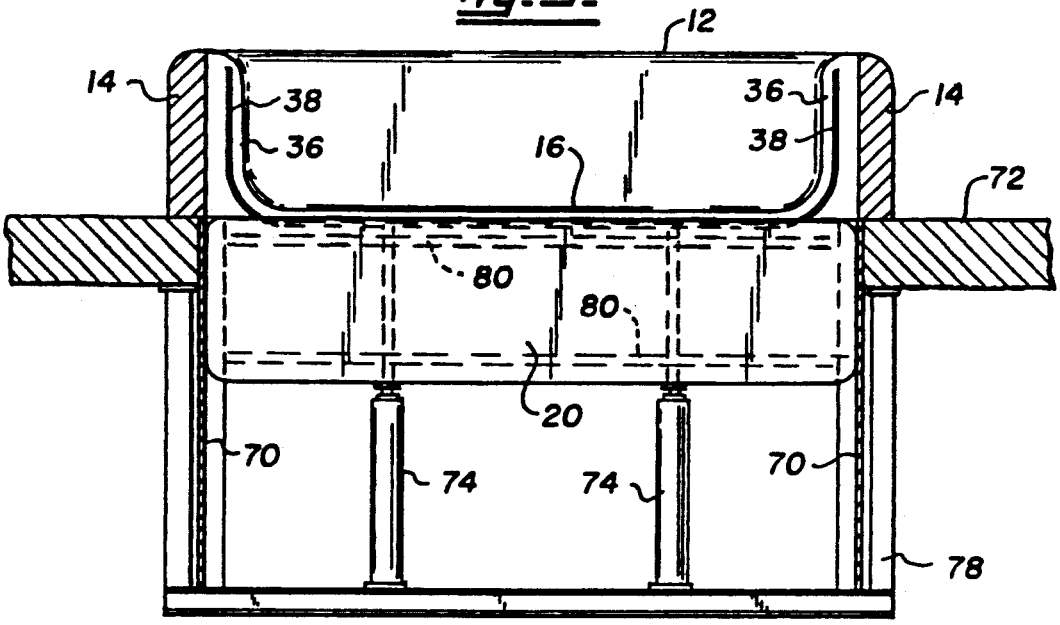
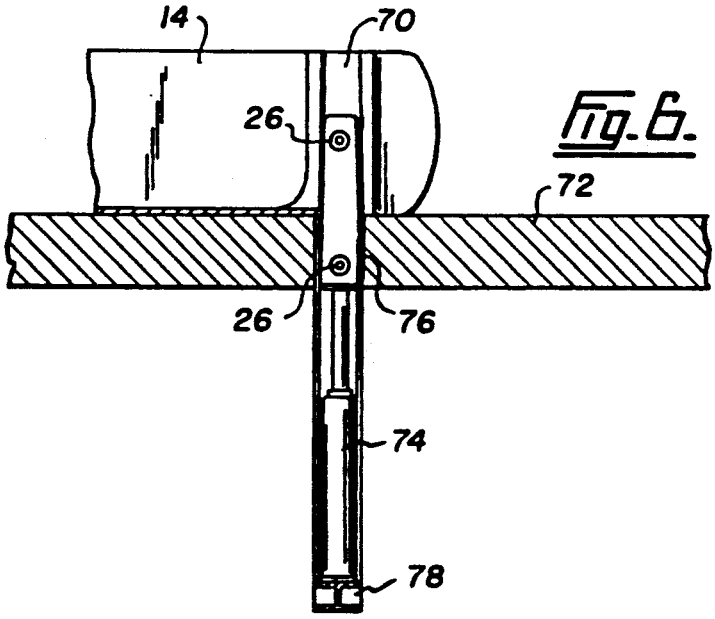
Fig. 6.

BATHING APPARATUS FOR HANDICAPPED PEOPLE AND THE LIKE

This application is a continuation-in-part application of U.S. application Ser. No. 388,795 filed Aug. 2nd, 1989 and issued as U.S. Pat. No. 4,993,087 on Feb. 19, 1991.

BACKGROUND OF THE INVENTION

The present invention relates to a bathtub and more particularly to a bathtub that has a side or front panel which slides downwards to allow a handicapped person in a wheelchair or on a trolley to move into the bathtub without having to climb over a side of the bathtub.

Handicapped people, such as paraplegics, and elderly people often require assistance to climb over the side of a bathtub. Whereas this may be acceptable in hospitals and in homes for the elderly, it always requires another person to be present which does not permit independence in the home.

Various attempts have been made to provide a bathtub that a handicapped person can use by himself. Some of these include bathtubs with special seats and sliding panels that lift up. One example of such a bathing arrangement is disclosed by the Houle et al. in U.S. Pat. No. 4,365,367. Another type of bathtub is provided by Hanson in U.S. Pat. No. 3,416,166 which shows a sliding door to lift up and move to one side and rest on a rail assembly thus providing an access into a bathtub. None of these units, however, permit an individual in either a wheelchair or on a trolley of some kind to advance into the bathtub and there is a need for such a bathtub for use in hospitals and in the home.

SUMMARY OF THE INVENTION

It is an aim of the present invention to provide a bathing apparatus which has a panel in the side of the bathtub that drops down and turns into an opening under the bathtub. In one embodiment a ramp is provided to allow an individual on a trolley or a wheelchair to roll directly into the bathtub.

It is a further aim of the present invention to provide a bathtub that can be used by a handicapped person who does not have full use of any or all limbs and yet can have a bath on his own without having to be assisted by another individual. It is a further aim to provide a bathtub system which can be adapted for use by either voice actuation or manual operation. A voice actuation can operate the sliding side panel and also control the flow and temperature of water into the bathtub, also drain the water out of the bathtub.

The present invention provides a bathing apparatus for handicapped people and the like comprising a bathtub having one fixed vertical side joined to two end walls extending up from a bottom surface, a single unitary sliding panel in the other vertical side of the bathtub, the sliding panel mounted in track means in two external walls extending beyond the other vertical side of the bathtub, the track means extending downwards and curved under the bathtub into an opening provided under the bathtub, allowing the sliding panel to be lowered, turned and slid into the opening under the bathtub to provide a lowered position to permit entry and exit to the bathtub, means to raise and lower the sliding panel between the lowered position and the raised position and sealing means to effect a seal for the sliding panel in the raised position.

BRIEF DESCRIPTION OF THE DRAWINGS

In drawings which illustrate embodiments of the invention,

FIG. 4 is an isometric view showing one embodiment of a bathing apparatus according to the present invention.

FIG. 5 is a cross-sectional view taken at line 5—5 of FIG. 4 showing the sliding panel of the bathtub in the lowered position.

FIG. 6 is a cross-sectional view taken at line 6—6 of FIG. 5.

DETAILED DESCRIPTION OF THE PREFERRED EMBODIMENTS

Figure 1:
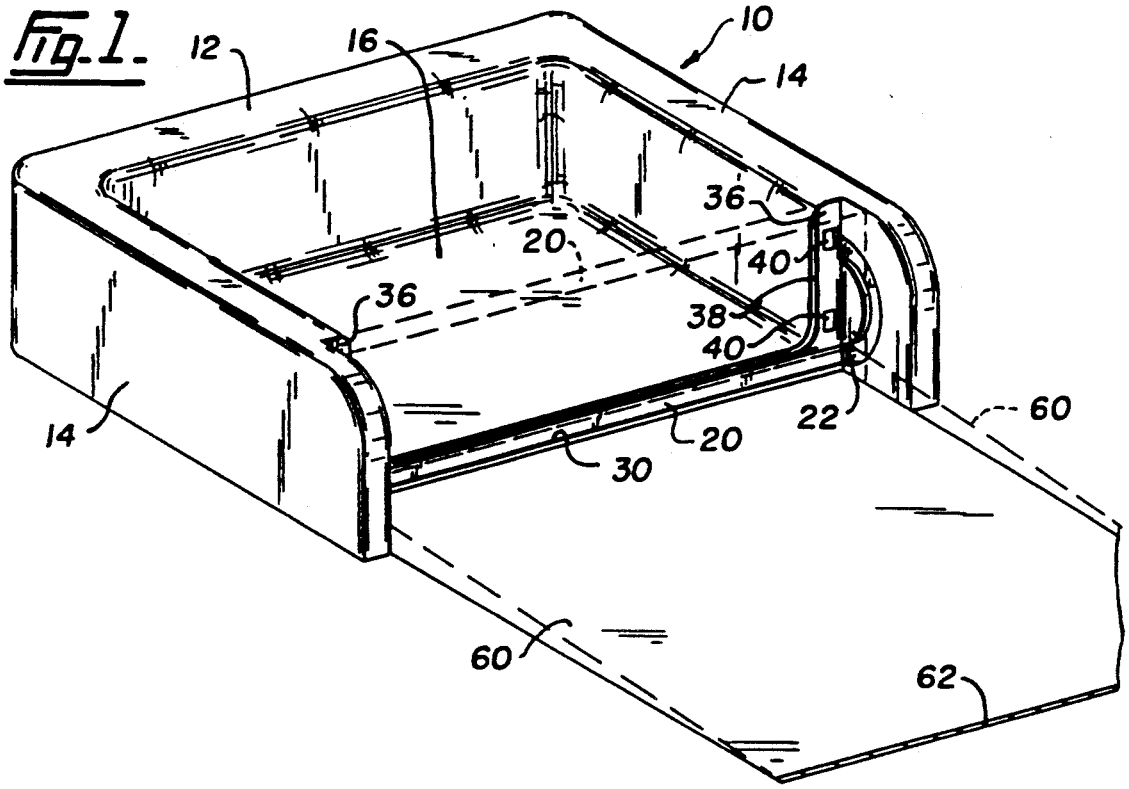
FIG. 1 is an isometric view showing another embodiment of a bathtub according to the present invention.
Figure 2:
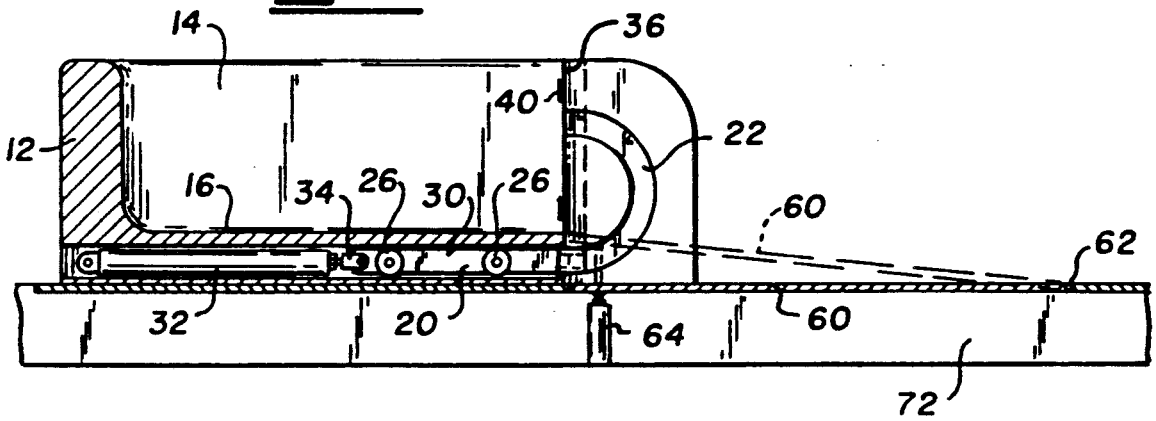
FIG. 2 is a side sectional view of the bathtub shown in FIG. 1.
Figure 3:
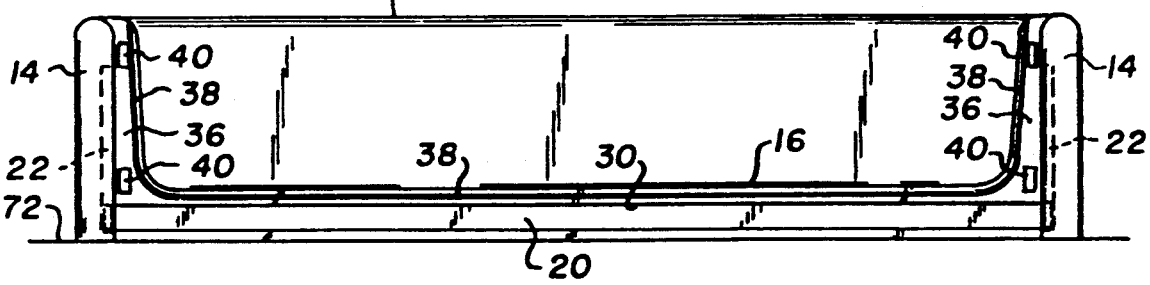
FIG. 3 is a front view of the bathtub shown in FIG. 1 showing the sliding panel of the bathtub in the open or lowered position.

Most bathtubs today are made of fiberglass, and this is the preferred material for the bathing apparatus of the present invention which includes a bathtub 10 as shown in FIGS. 1 to 3 with a fixed side 12 joined to two end walls 14. As can be seen more easily in FIGS. 2 and 3 the bottom 16 of the tub is integral with the fixed side wall 12 and end walls 14.

The other side of the bathtub 10 has a sliding panel 20 which has tracks 22 at each side fitting in the ends 14, which extend outwards beyond the edge of the bathtub 10. The panel 20 has side rollers 26 at each end which each fit into a guide track 22. An opening 30 is provided under the bathtub 10 and the panel 20, when lowered from the raised position to the lowered position slides in the curved guide tracks 22 and moves down into the opening 30 under the bathtub 10. Two hydraulic cylinders or linear actuators 32 are provided underneath the bathtub 10 with a link or swivel 34 to join to the panel 20 so that when the panel is pushed out of the opening 30 and turns to move into the raised position, the swivel 34 allows the turn to be made. In the reverse operation, as the linear actuator pulls on the swivel 34, the panel turns on the curved guide tracks 22 through 90° and slides into the opening 30.

As seen more clearly in FIG. 3, an edge 36 extends along the bottom 16 of the bathtub and at the two end walls 14. The edge 36 has a rubber strip seal 38 extending there along and four electromagnets 40 are positioned on the edge 36 at each end wall 14 which when activated engage appropriate magnetic material associated with the sliding panel 20 to retain the sliding panel 20 in the closed position, assisting in sealing the panel 20 to the bathtub 10 by means of the rubber strip 38.

Both the linear actuators 32 and the electromagnets are operated by twelve volts DC. A twelve volt battery with a battery charger is provided so the battery remains constantly charged, and in the event of a power failure the movement of the panel is not affected. The electrical control system for the complete bath including electrical sensors, limit switches and the like are all twelve volt DC. By using twelve volts the safety of an individual is ensured as this voltage does not provide a harmful electric shock, and is accepted in accordance with Federal Standards.

At the entrance to the bathtub 10, as shown in FIG. 1 and 2, is a ramp 60 extending from hinge 62 ending just prior to the edge of the bathtub 10. When the panel 20 is in the lowered position, a hydraulic or linear actuator 64 raises the ramp 60 to approximately the height of the bottom 16 of the bathtub 10 so that a wheelchair, gurney, trolley or the like may roll straight into the bathtub 10. The linear actuator 64 is shown positioned in the floor joists, however if no room is available here, then a side actuating unit may be provided which fits on top of the floor rather than underneath. In this manner the bathtub 10 shown in FIGS. 1, 2 and 3 may be installed in a standard residential house without having to cut holes in the floor.

Another embodiment of a bathtub is shown in FIG. 4, 5 and 6 where the sliding panel 20 is tapered with a thinner top than a base, and has grooves 70 in each of the ends 14 tapered to match the sliding panel 20. In a raised position the sliding panel 20 wedges into the grooves 70, and the seal 38 in the edge 36 around the two end walls 14 and along the bottom 16 of the bathtub seals against the surface of the panel 20. The wedge action assists in forming the seal and prevents water escaping. The grooves 70 extend down below the floor 72, and two hydraulic cylinders or linear actuators 74 are shown to lower the sliding panel 20 to a lowered position through a slot 76 in the floor 72, as illustrated in FIG. 5, so that the top of the panel 20 is substantially level with the bottom surface 16 of the bathtub. This allows a person in a wheelchair or trolley to move over the lowered panel 20. Alternatively a ramp similar to that shown in FIGS. 1 and 2 may be provided. At the edges of the panel 20 rollers or guides 26 fit into the grooves 70 to provide a smooth travel path.

As illustrated in FIGS. 5 and 6, a frame 78 is provided beneath the bathtub 10 to act as a support for the hydraulic cylinders or linear actuators 74 and the sliding panel 20.

The sliding panel 20 is also made of fiberglass similar to the rest of the bathtub 10, but has steel reinforcing bars 80 embedded therein to provide longitudinal strength to ensure the panel 20 retains its shape even when the bathtub 10 is full of water. The steel reinforcing bars 80 are provided in the sliding panels 20 as shown in FIG. 5.

The embodiment shown in FIGS. 4, 5 and 6 is suitable for hospitals and the like and requires a slot 76 in the floor 72 and a frame 70 mounted under the floor 70. Such an installation can generally be made in existing buildings. FIGS. 1, 2 and 3 illustrate an embodiment of a bathtub 10 which does not require a slot 76 in the floor 72.

Figure 7:
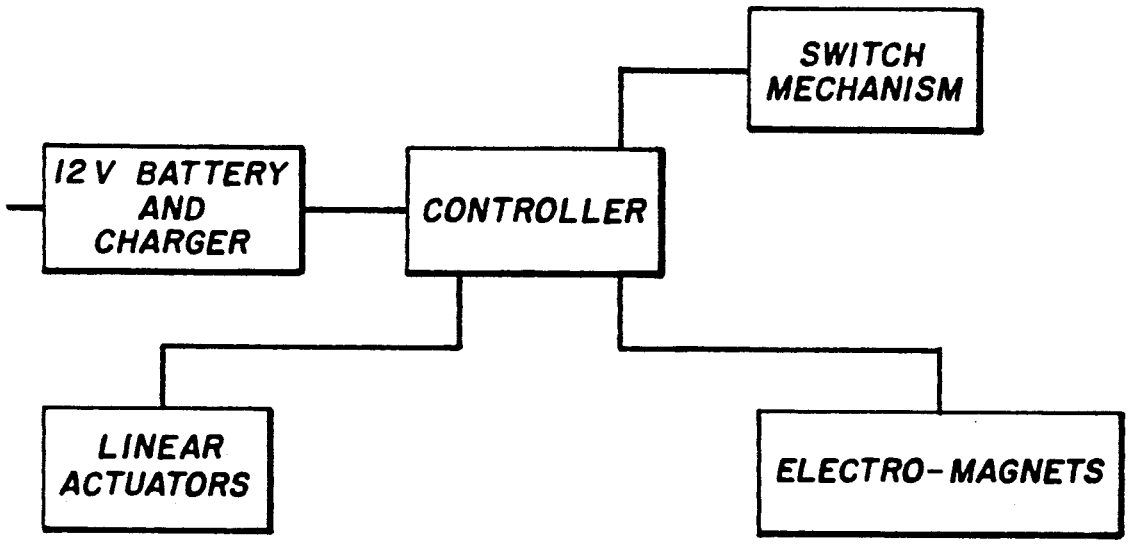
FIG. 7 is a block diagram illustrating control of the operation of the bathtub.

FIG. 7 illustrates the operational diagram for the bathtub. Power to the controller is supplied from a 12V battery with a standard commercial battery charger. The battery is preferably mounted away from the bathtub and in a location where it cannot become wet. The switch mechanism, which may be a voice actuator, signals the controller to operate the linear actuators to raise or lower the panel and apply the electro-magnets to ensure the panel is sealed in the raised position. The controller may also supply controls to solenoid valves to control water into the bathtub and drain water from the bathtub.

Various dimensions of bathtubs may be provided. For quadraplegics or the like where a patient has to enter the bathtub on a gurney or trolley, specially designed for use in water and to fit into the bathtub, bathtubs having lengths of eight feet or more may be provided.

Figure 8:
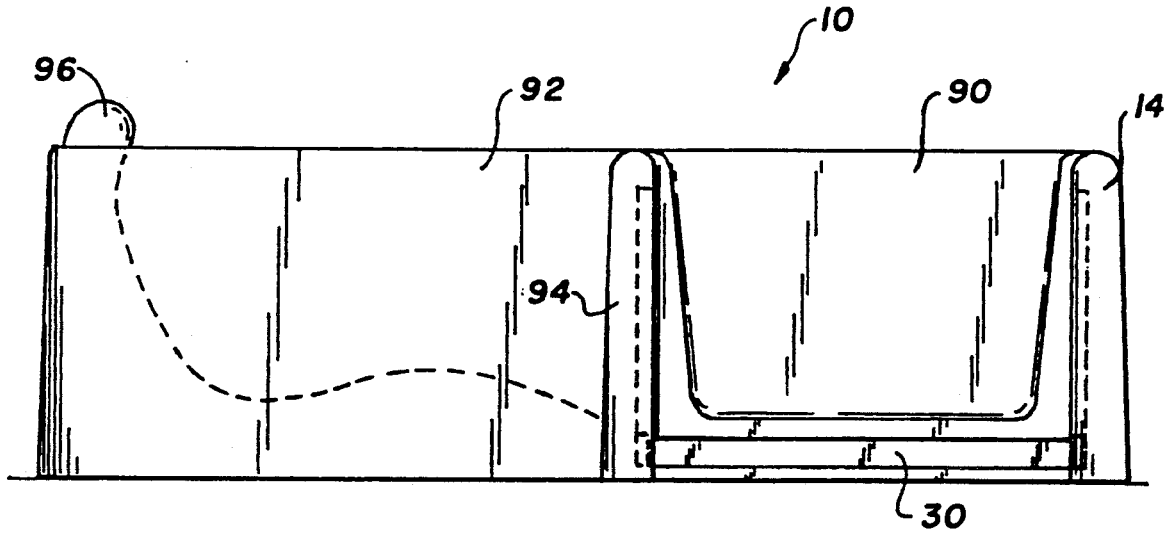
FIG. 8 is a front view of another embodiment of a bathtub with a sliding panel only extending for a portion of the vertical side.

FIG. 8 illustrates another embodiment of a bathtub wherein a small panel 90 is shown that moves down into opening 30. The panel 90 represents only a portion of the side 92 of the bathtub 10. An external wall 94 extends out from the side 92 of the bathtub and has tracks 22 as shown in FIGS. 1 and 2. The bathtub 10 has a contoured shape 95 as shown in dotted line, and may have a waterproof vinyl coating with soft cushioning underneath. A headrest 96 is also shown.

For household use smaller bathtubs, even those of five feet in length may be provided. Bathtub faucets may be hand operated or have 12 volt electric solenoids for operation. A temperature sensing control may also be provided so that the temperature may be preselected. The drain may also have a solenoid operated valve, and in some instances two drains may be provided one at each end of the tub. Large faucets or two faucets may also be provided for quick filling. This is particularly true in a hospital but may not be necessary for residential use. Heat sensors may also be included for determining water temperature.

A water sensor is also provided in the bathtub to prevent opening of the sliding panel when the bathtub is full of water. This sensor may include a timing sensor which does not allow the side to be opened until the solenoid valve of the drain has been opened for a predetermined time to ensure that no water remains in the bathtub.

As previously stated the electrical system is twelve volt DC with a battery charger for connection to household power. Thus in case of a power failure the system still continues to operate. Furthermore by utilizing twelve volts you avoid the problems of high voltage in a bathroom. Control of a bathtub may be by a small computerized unit to perform all functions. As previously stated a voice actuator may be used to control every function. In the case of a voice actuated control the different commands would operate different functions. Furthermore it is possible to program the actuation system so that only one person's voice operates the different controls. Overrides and manual operation may of course be provided.

Various changes may be made to the embodiments disclosed herein without departing from the scope of the present invention which is limited only by the following claims.

The embodiments of the present invention in which an exclusive property or privilege is claimed are defined as follows:

1. A bathing apparatus for handicapped people and the like comprising:

a bathtub having a first and a second vertical side and a first and a second end wall extending up from a bottom surface, one vertical side being fixed, said second vertical side of the bathtub having a single unitary sliding panel therein, the sliding panel mounted in track means in two external walls extending beyond the second vertical side of the bathtub, the track means extending downwards and curved under the bathtub into an opening provided under the bathtub, allowing the sliding panel to be lowered, turned and slid into the opening under the bathtub to provide a lowered position to permit entry and exit to the bathtub, means to raise and lower the sliding panel between the lowered position and the raised position, and sealing means to effect a seal for the sliding panel in the raised position.

2. The bathing apparatus according to claim 1 wherein the track means are rails in curved grooves in the two external walls, and rollers on the ends of the sliding panel run on the rails.

3. A bathing apparatus according to claim 2 wherein the means to raise and lower the sliding panel comprises at least one hydraulic cylinder under the bathtub.

4. The bathing apparatus according to claim 2 wherein the means to raise and lower the sliding panel comprises at least one electrical linear actuator operated at 12 volts DC.

5. The bathing apparatus according to claim 4 including a battery to supply power to the linear actuator.

6. The bathing apparatus according to claim 1 including at least one electromagnet at each of said external walls of the bathtub to magnetically engage the top of the sliding panel when in the raised position and assist in sealing the sliding panel to the bathtub.

7. The bathing apparatus according to claim 1 wherein the bathtub is formed of fiberglass and the sliding panel is formed of fiberglass with a steel bar reinforcement extending along its length.

8. The bathing apparatus according to claim 1 including a floor ramp means external of the bathtub adjacent the sliding panel and means to raise the ramp edge adjacent the sliding panel to a height at least as high as the bottom surface of the bathtub when the sliding panel is in the lowered position.

9. The bathing apparatus according to claim 8 wherein the means to raise the ramp edge comprises an electrical linear actuator operating at 12 volts DC.

10. The bathing apparatus according to claim 1 wherein the sliding panel extends between the two end walls of the bathtub and forms the other vertical side of the bathtub, and wherein the two external walls extending beyond the other vertical side of the bathtub are extensions of the two end walls.

* * * * *